US009534879B1

(12) United States Patent
Grubelich et al.

(10) Patent No.: US 9,534,879 B1
(45) Date of Patent: Jan. 3, 2017

(54) GAS POWERED FLUID GUN WITH RECOIL MITIGATION

(71) Applicant: Sandia Corporation, Albuquerque, NM (US)

(72) Inventors: Mark C. Grubelich, Albuquerque, NM (US); Gerold Yonas, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 15/004,666

(22) Filed: Jan. 22, 2016

Related U.S. Application Data

(60) Division of application No. 14/055,829, filed on Oct. 16, 2013, now Pat. No. 9,272,296, which is a division of application No. 12/948,801, filed on Nov. 18, 2010, now Pat. No. 8,579,209, which is a continuation-in-part of application No. 11/484,938, filed on Jul. 12, 2006, now abandoned.

(51) Int. Cl.
*B05B 1/26* (2006.01)
*F42B 33/06* (2006.01)
*F41B 9/00* (2006.01)

(52) U.S. Cl.
CPC ..... *F42B 33/062* (2013.01); *F41B 9/0021* (2013.01)

(58) Field of Classification Search
CPC ..... B05B 1/26; B05B 1/34; B05B 7/32; F23D 11/24; F23D 14/28
USPC ..... 239/525–526, 461, 518, 337, 347, 370, 239/373, 396; 169/9, 11, 30, 71
See application file for complete search history.

(56) References Cited

U.S. PATENT DOCUMENTS

| | | | | |
|---|---|---|---|---|
| 2,597,727 | A | 5/1952 | Hanson | |
| 2,745,700 | A | 5/1956 | Phalen | |
| 3,612,405 | A * | 10/1971 | Heinrich | B24C 5/04 239/427.3 |
| RE30,887 | E | 3/1982 | Turley | |
| 5,339,987 | A | 8/1994 | D'Andrade | |
| 6,364,162 | B1 | 4/2002 | Johnson et al. | |
| 2002/0083736 | A1 | 7/2002 | Kotliar | |
| 2006/0090907 | A1 | 5/2006 | Crabtree et al. | |
| 2008/0017391 | A1 | 1/2008 | Lenz | |

* cited by examiner

*Primary Examiner* — Justin Jonaitis
(74) *Attorney, Agent, or Firm* — Daniel J. Jenkins

(57) ABSTRACT

A gas powered fluid gun for propelling a stream or slug of a fluid at high velocity toward a target. Recoil mitigation is provided by a cavitating venturi that reduces or eliminates the associated recoil forces, with minimal or no backwash. By launching a quantity of water in the opposite direction, net momentum forces are reduced or eliminated.

15 Claims, 5 Drawing Sheets

GAS POWERED FLUID GUN WITH RECOIL MITIGATION

CROSS-REFERENCE TO RELATED APPLICATIONS

This application is a divisional application of U.S. patent application Ser. No. 14/055,829, filed Oct. 16, 2013, entitled "Gas Powered Fluid Gun with Recoil Mitigation," which is a divisional application of U.S. patent application Ser. No. 12/948,801, filed Nov. 18, 2010, entitled "Gas Powered Fluid Gun with Recoil Mitigation," now U.S. Pat. No. 8,589,209, which is a Continuation-in-Part (CIP) of patent application Ser. No. 11/484,938 filed Jul. 12, 2006, now abandoned, all of which are incorporated herein by reference in their entireties.

STATEMENT REGARDING FEDERALLY SPONSORED RESEARCH OR DEVELOPMENT

The Government has rights to this invention pursuant to Contract No. DE-AC04-94AL85000 awarded by the U.S. Department of Energy.

BACKGROUND OF THE INVENTION

The present invention relates to methods and structures for disrupting targets using a gas powered (pressurized) fluid gun.

In order to disrupt improvised explosive devices (IEDs) or rioting individuals, breach doors or structures, and arrest the movement of unauthorized vehicles, it would be desirable to have a stand off device that could be carried via backpack, carried by vehicle (e.g., car, truck, aircraft, or trailer), or emplaced at a critical locations (e.g., an embassy) to accomplish such tasks. While this has been accomplished with solid projectile firing guns (e.g., firing bean bag rounds or rubber bullets), water cannons (fire trucks), and nets, there are serious limitations to each of these technologies.

Relevant prior art inventions that use pressurized air to propel water from a storage container include a fire extinguisher (e.g., U.S. Pat. No. 2,745,700 to Phalen), and toy water guns (e.g., U.S. Pat. No. 5,339,987 to D'Andrade; and U.S. Pat. No. 6,364,162 to Johnson et al.). None of these patents teach structures or methods for mitigating or eliminating momentum-induced recoil forces.

BRIEF SUMMARY OF THE INVENTION

The present invention relates to a gas powered fluid gun and concomitant method for launching a stream or slug of fluid towards a target. One method comprises storing gas in a gas tank at greater than ambient pressure; providing fluid to be propelled in a fluid tank; conducting pressurized gas between the first and second tank; conducting fluid from the pressurized fluid tank to an opening in a side of a gun barrel via a fluid discharge valve; ejecting a rapidly-moving slug of the fluid from one end of the gun barrel towards a target; and simultaneously ejecting a rearward-moving stream of the fluid from the rear end of the gun barrel. By launching a quantity of water in the opposite direction, net momentum forces are reduced or eliminated. The gas can comprise air, nitrogen, helium, carbon dioxide, nitrous oxide, steam, or a mixture thereof. The fluid can comprise one or more of water, lubricants, foaming agents, thickening agents, gelling agents, tagants, chemical agents, carbon dioxide, nitrous oxide, malodorants, hydrocarbons, and fire suppressing agents. Recoil forces can be mitigated by using a recoil mitigation device located at an end opposite from that which the fluid slug is ejected. Examples of recoil mitigation devices include a cone for making a conical fluid sheet, a device forming multiple impinging streams of fluid, a cavitating venturi, one or more spinning vanes, or an annular tangential entry/exit. A user can control the volume of fluid ejected, diameter of the stream of fluid ejected, and length of the stream of fluid (slug) ejected.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
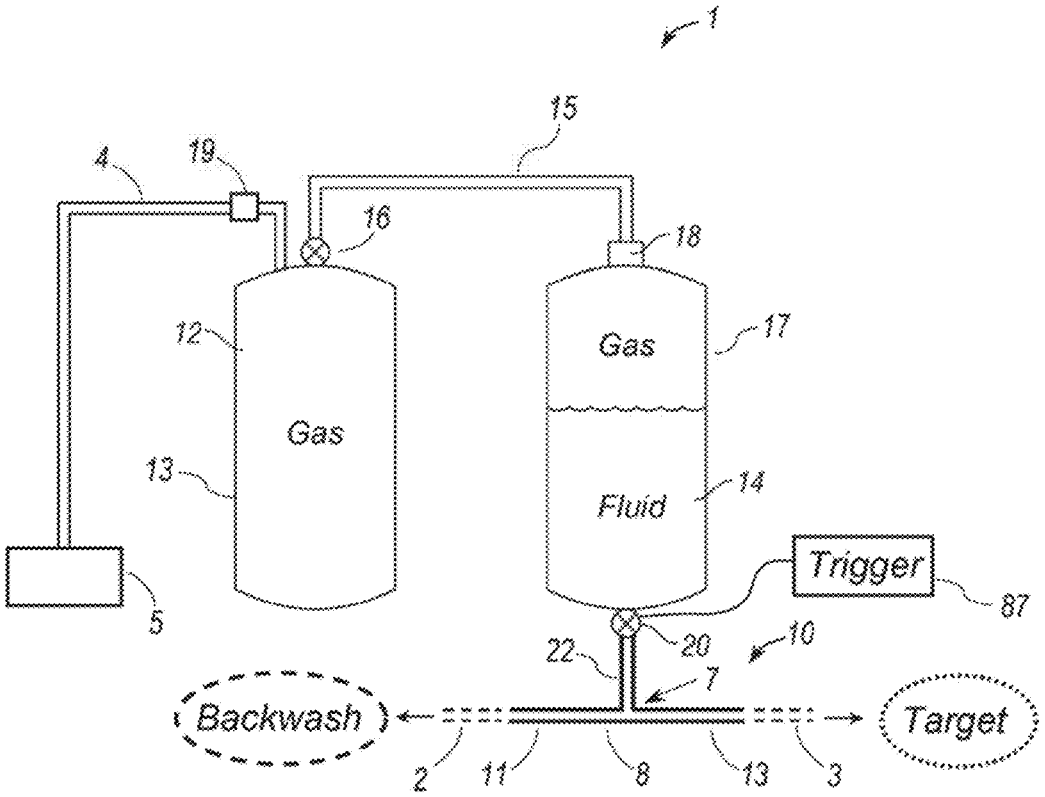
FIG. 1 is a schematic diagram of an embodiment of the invention.

The present invention relates to a gas powered fluid gun, and method of use, that can accomplish disruption tasks with minimum collateral damage. The invention can be tailored for disrupting a wide variety of targets ranging from humans to vehicles. The invention employs a gas stored at high pressure (e.g., air, nitrogen, helium, carbon dioxide, nitrous oxide, steam, etc.) to pressurize a working fluid, such as water (which can be seawater). The fluid is propelled from the device at high speed and directed at the target. The volume, length and diameter (or mass) of fluid, velocity, and velocity gradient of the stream can all be controlled to achieve the desired target effects.

In the present invention, stored high-pressure gas is used to propel the fluid. The energy stored in the gas can be accumulated over a long period of time thereby requiring minimal peak power input to pressurize the gas. When the fluid is rapidly expelled from the device by the gas, high peak powers can be realized, without requiring the burden of large heavy pumps and power sources. By regulating the gas pressure, the fluid speed can be accurately controlled. Valves can be used to control the mass of fluid delivered to the target.

Materials can be added to the fluid to produce additional effects. For example, lubricants can be added to a water-based system to reduce traction at the target or agents added to thicken or gel the fluid (e.g., polysaccharides, glycols, carboxymethylcellulose, hydroxyethylcellulose, acrylates, acrylim ides, polyethylene oxide, colloidal silica, etc), dissolved gases (carbon dioxide) can be used that produce a foam on impact with the target; and tagants (e.g., dyes); or readily absorbed or inhaled chemical agents (e.g., tear gas, nitrous oxide, malodorants, etc) can be used to provide irritant, anesthetic, or other deleterious effects to the target. Fire suppressing agents can be used to prevent or mitigate combustion. In addition, other working fluids in place of water can be used such as carbon dioxide, nitrous oxide, hydrocarbons, etc., to enhance or produce the desired down range effects.

Pressurized gas (e.g., compressed air) is used to pressurize a fluid tank (e.g., water). The fluid tank can be isolated from the gas tank via a valve prior to use. Next, a fluid discharge valve is opened to allow the exit of the fluid from the fluid tank, being propelled by the pressurized gas pushing it forward. The fluid travels through piping or tubing, and then rapidly exits out through an optional nozzle that controls the diameter of the stream. The fluid flow can be non-turbulent (laminar flow) so as to maintain the integrity of the column of fluid or "jet" as a rod of water. As the jet travels through the air, the tip of the jet will erode. By keeping the fluid discharge valve open long enough, a jet or slug of water will reach the target.

By controlling the timing of when to close the fluid discharge valve, the length of the fluid column (slug) can be accurately controlled. Closing the valve early allows a blast of mist or droplets to reach the target. In this way, the momentum delivered to the target can be controlled. For soft target (e.g., canines or humans), a short slug of lower velocity water can be used to provide the incentive for the target to leave the area, and higher velocity and/or longer slugs can be used to disable an adversary. For hard targets (e.g., against vehicles or for breaching) a long, high velocity slug can be used to deliver maximum momentum to the target thereby halting its approach in the case of a vehicle, or knocking down the target in the case of a door or wall. In the case of a suspected improvised explosive device (IED), the IED can be rendered inoperative and/or displaced from its location by the blast of fluid. Multiple pressurized gas tanks can be manifolded together to pressurize one or more fluid tank(s).

In all of these scenarios, the fluid produces little collateral damage, can act a fire retardant, and will dissipate harmlessly in the environment. In comparison to a solid projectile system (e.g., military small arms) little momentum can be transferred to a vehicle to stop it or push it from its intended path. The use of traditional breaching devices (e.g., rams or explosives) usually requires the operators to be in close proximity to the target. The invention allows significant stand off without endangering the breaching team. Finally, when used directly against individuals, beanbag rounds and rubber bullets can produce significant injuries and fatalities. Tailoring the momentum of the fluid slug can preclude this from happening.

For large, vehicle-born systems or backpack systems, recoil can be excessive. In order to mitigate recoil (impulse to the shooting platform), the duration of the firing can be controlled, and/or a recoil mitigation device can be employed to neutralize or reduce the recoil. By directing some of the fluid in the opposite direction from the jet or slug, the recoil can be minimized or eliminated. In order to prevent this "back blast" or "backwash" of fluid from damaging personal or objects it is desirable to dissipate the recoil mitigating stream rapidly. This can be done in several ways, such as causing a conical stream of the fluid to be ejected rewards. This conical sheet will rapidly break up. Alternatively, multiple nozzles can be employed that impinge on each other, thereby further breaking up the stream. Alternatively, a cavitating venturi can be employed to partially vaporize the water as it is ejected rewards. Alternatively, a rotational flow can be imparted via vanes (fixed or rotating vanes) or via an annular, swirling discharge to destabilize the rearward stream.

FIG. 1 illustrates an embodiment of a system 1 comprising a gas powered fluid gun 10 with recoil mitigation and associated equipment. Compressor 5 supplies pressurized gas 12 to gas storage tank 13 via a first gas supply line 4, with the pressure being controlled by pressure regulator 19. When pressurization valve 16 is open, pressurized gas 12 flows from gas storage tank 13 into fluid storage tank 17 (which can be partially filled with a fluid 14) via a second gas supply line 15. The pressure in fluid storage tank 17 is regulated by pressure regulator 18. When triggered by an operator or a control signal from a computer, fluid ejection valve 20 opens and allows pressurized fluid 14 to flow from fluid storage tank 17 into fluid supply line 22. Fluid supply line 22 is fluidically connected to an opening 7 (penetration) in a side of gun barrel 8 (e.g., via a T-junction). Gun barrel 8 has a central bore, an open front end 11, an open rear end 13, a side, and an opening 7 through the side for conveying fluid into the central bore. The opening 7 in the side of gun barrel 8 is located at some point (e.g., midway) in-between the two opposite ends 11 and 13 of gun barrel 8. Gun barrel 8 is open at both of its ends 11 and 13. Fluid 14 leaves supply line 22 and then fluid 14 splits at T-junction 7 into two separate flow streams (streams 2 and 3) that move in substantially opposite directions through gun barrel 8. Forward moving stream 3 exits from the front end 13 of gun barrel 8 and travels towards (and hopefully impacts) a target. Rearward-moving stream 2 exits from the rear end 11 of gun barrel 8; creating backwash, and reducing (or eliminating) momentum recoil forces. Because streams 2 and 3 flow in opposite directions, the momentum of the rearward-moving stream 2 reduces the momentum recoil forces imparted by forward-moving stream 3 onto gun barrel 8 (and any structure attached thereto, e.g., fluid storage tank 17 and fluid supply line 22).

Referring still to FIG. 1, the inside diameter of gun barrel 8 can be the same at both ends (11 and 13), or they can be different at each end. For example, the inside diameter of barrel 8 at the front end 13 can be larger than the inside diameter of barrel 8 at the rear end 11. Conversely, the inside diameter of barrel 8 at the front end 13 can be smaller than the inside diameter of barrel 8 at the rear end 11. Optionally, an adjustable nozzle (not shown in FIG. 1) can be attached to the front end 11 of gun barrel 8 for changing the diameter and velocity of forward-facing exit stream 3. Optionally, or additionally, an adjustable nozzle (not shown in FIG. 1) can be attached to the rear end 13 of gun barrel 8 for changing the diameter and velocity of forward-facing exit stream 3. Fluid ejection valve 20 can be a rapidly-opening/closing valve, such as an in-line plug valve, an electromagneticaly-controlled valve, or pneumatically operated valve. Actuations of valve 20 can be controlled/actuated by a trigger 87 that is activated by an operator or by a signal from a computer.

Figure 2A:
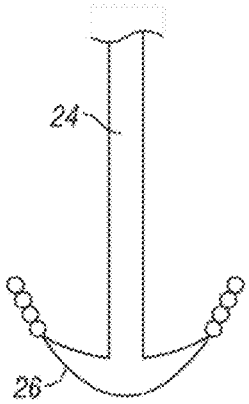
FIG. 2A is a diagram of a long slug of fluid ejected from the invention.
Figure 2B:
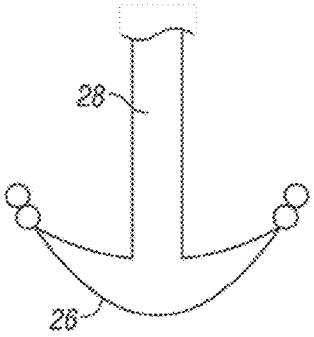
FIG. 2B is a diagram of a short slug of fluid ejected from the invention.

FIG. 2A illustrates a long slug 24 ejected from the invention with eroding tip 26, and FIG. 2B illustrates a short slug 28 with eroding tip.

Figure 3:
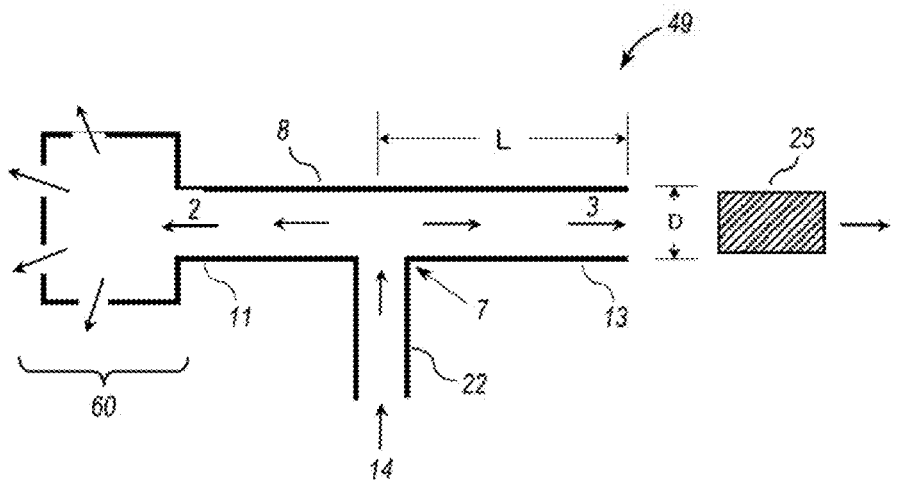
FIG. 3 is a schematic diagram of another embodiment of the invention.
Figure 10:
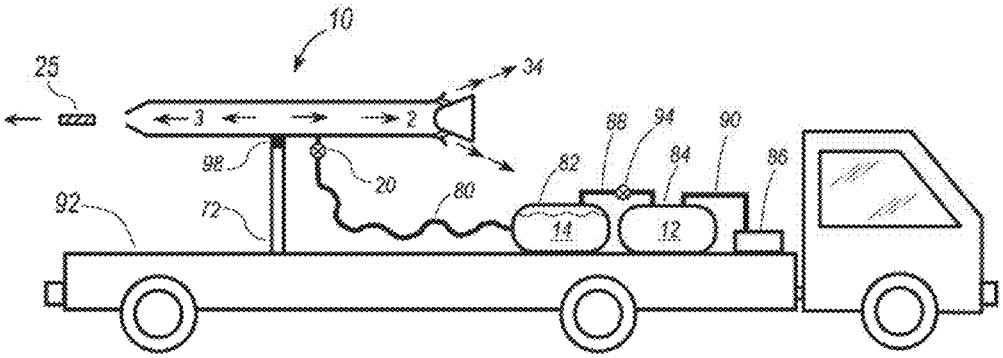
FIG. 10 is a schematic diagram of another embodiment of the invention.

FIG. 3 illustrates another embodiment of a gas powered fluid gun 49 with recoil mitigation device 60. Pressurized fluid 14 flows through supply tube 22 and then splits at T-junction 7 into two flow streams (2 and 3) moving in substantially opposite direction through gun barrel 8. Forward-moving stream 3 exits as slug 25 from the front end 13 of gun barrel 8 and travels towards (and eventually impacts) a target. Gun barrel 8 has an inner diameter=D, and a length=L of the length of barrel 8 that carries the forward-moving stream 3. This figure shows a generic recoil mitigation device 60 that is disposed at the rear end 11 of gun barrel 8. Recoil mitigation device 60 redirects the direction and momentum of the rearward-moving stream 2 into other directions and other (e.g., multiple) streams, so as to minimize or eliminate the recoil forces imparted by forward-moving stream 3 on fluid tank 17 and fluid supply line 22; as well as to minimize or eliminate the backwash from the rear of gun barrel 8. Recoil mitigation device 60 can be attached to the rear end 11 of gun barrel 8 (as shown in FIG. 3); or it can be located adjacent to, but not attached to, the rear end 11 of gun barrel 8 (as shown in FIG. 10). In some embodiments, the Length/Diameter ratio (L/D) of gun barrel 8 can be chosen to be sufficiently small so that fluid 14 exiting the far end 13 of gun barrel 8 is laminar (i.e., smooth and not turbulent).

Figure 4:
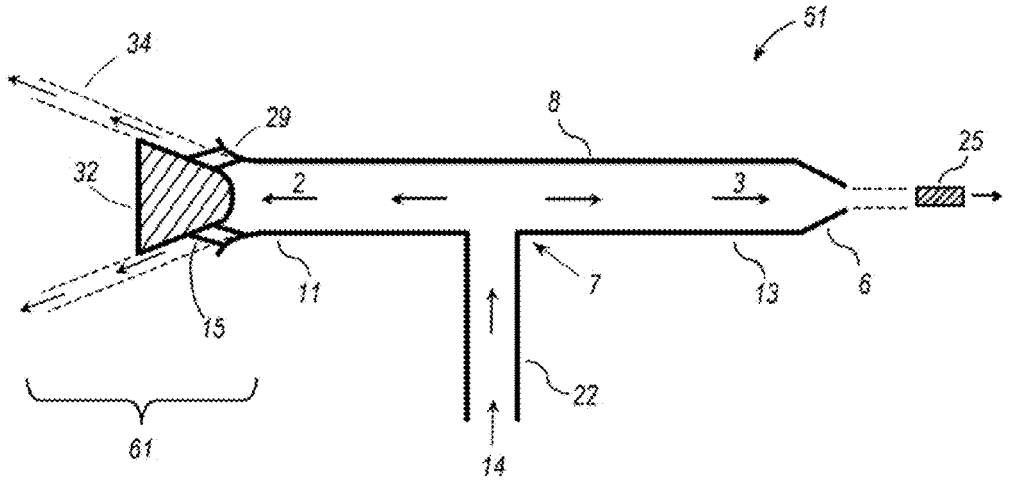
FIG. 4 is a schematic diagram of another embodiment of the invention.

FIG. 4 illustrates another embodiment of a gas powered fluid gun 51 with recoil mitigation device 61. Pressurized fluid 14 flows through supply tube 22 and then splits at T-junction 7 into two flow streams (2 and 3) moving in substantially opposite direction through gun barrel 8. Forward-moving stream 3 flows through converging nozzle 6 and then exits as slug 25 from the front end 13 of gun barrel 8 and travels towards (and eventually impacts) a target. Nozzle 6 can have an adjustable geometry, so that different diameters and spray characteristics can be selected. Rearward-moving stream 2 impacts recoil mitigation device 61, which comprises a cone 32 that creates a conical sheet of fluid 34 that breaks up rapidly. Cone 32 can be attached to the rear end 11 of gun barrel 8 with struts 15. Optionally, the rear end 11 of gun barrel 8 can comprise outwardly flared ends 29.

Figure 5:
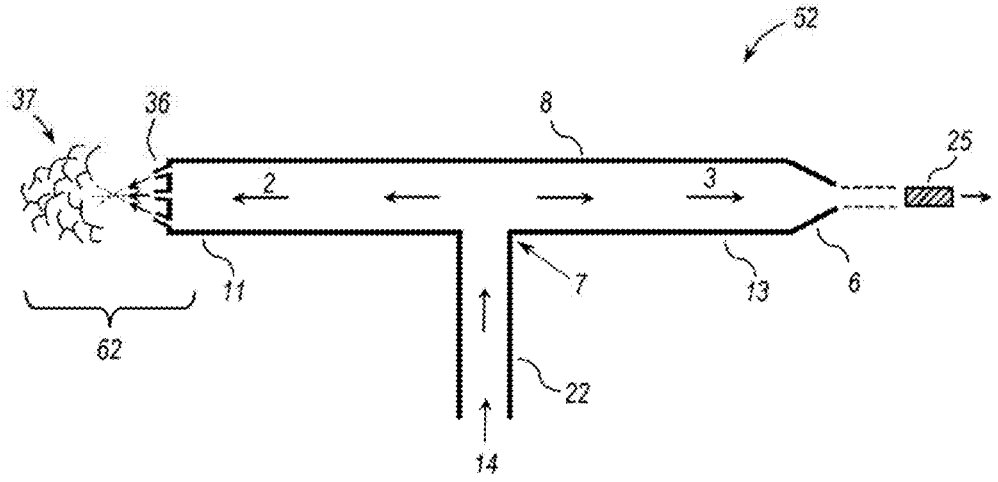
FIG. 5 is a schematic diagram of another embodiment of the invention.

FIG. 5 illustrates another embodiment of a gas powered fluid gun 52 with recoil mitigation device 62. Rearward-moving stream 2 impacts recoil mitigation device 62, which comprises multiple nozzles that create multiple impinging streams 36 that destabilize the backward flowing jet into a mist or cloud 37.

Figure 6:
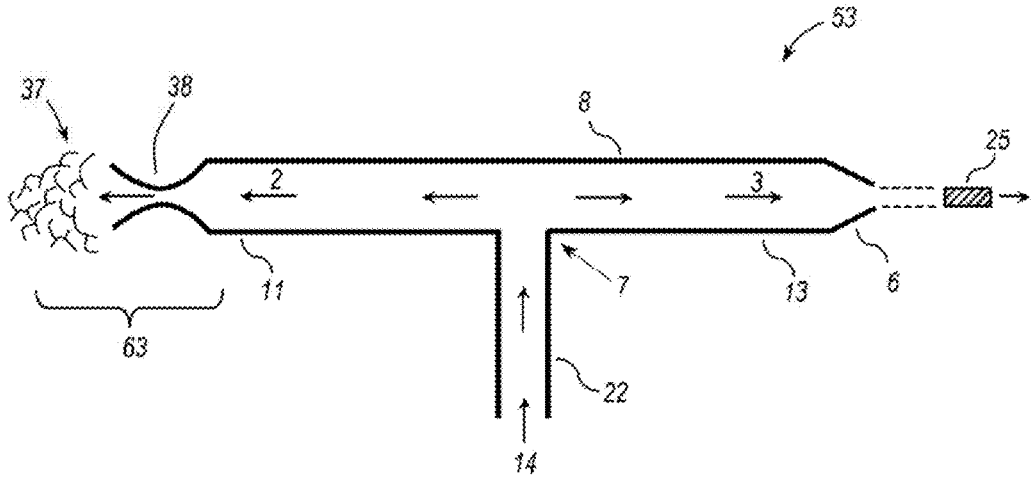
FIG. 6 is a schematic diagram of another embodiment of the invention.

FIG. 6 illustrates another embodiment of a gas powered fluid gun 53 with recoil mitigation device 63. Recoil mitigation device 63 comprises a cavitating venturi 38. The rearward-flowing fluid stream 2 drops below vapor pressure just past the converging throat 38 and thereby "flash" vaporizes, producing a mist or foamed fluid cloud 37 (i.e., two phase result).

Figure 7:
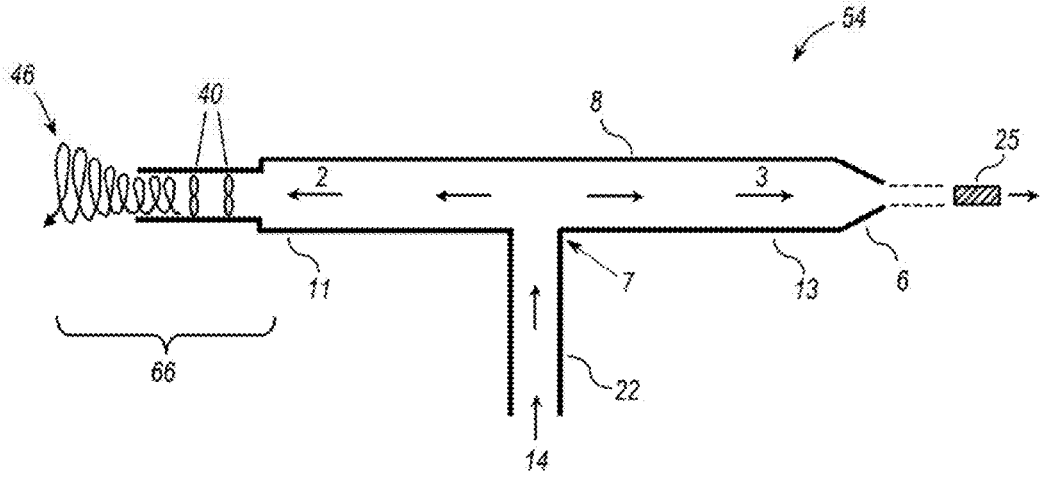
FIG. 7 is a schematic diagram of another embodiment of the invention.

FIG. 7 illustrates another embodiment of a gas powered fluid gun 54 with recoil mitigation device 66. Recoil mitigation device 66 comprises one or more turning vanes 40, which causes rearward-moving stream 2 to form a rotating, swirling fluid stream 46 that breaks up quickly. Vanes 40 can be movable (e.g., spinning), or can be non-movable (attached) to rear end 11 of gun barrel 8.

Figure 8:
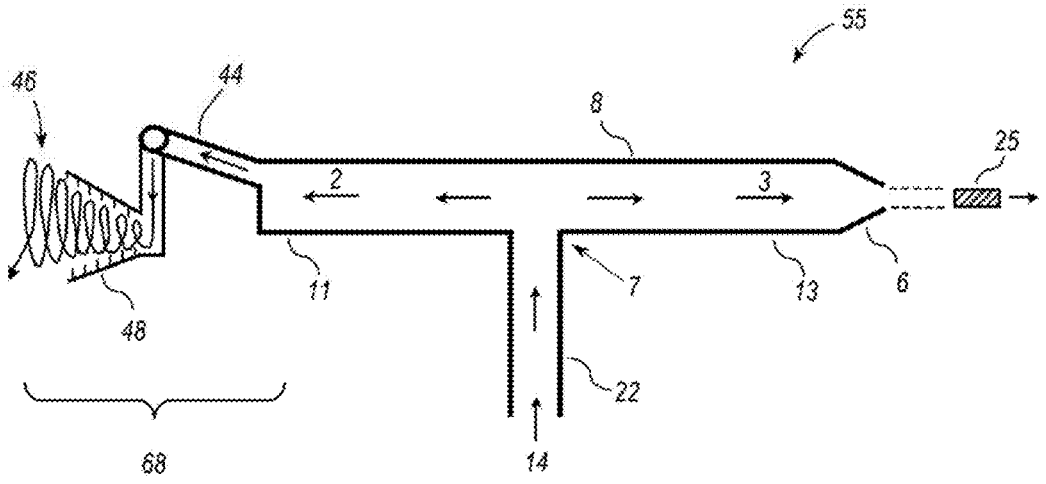
FIG. 8 is a schematic diagram of another embodiment of the invention.

FIG. 8 illustrates another embodiment of a gas powered fluid gun 55 with recoil mitigation device 68. Recoil mitigation device 68 comprises an annular tangential entry/exit structure 44 and spiral-shaped channels in exit cone 48 that (like in FIG. 7) causes rearward-moving stream 2 to form a rotating (whirling/swirling) stream 46 of fluid that breaks up quickly.

Figure 9:
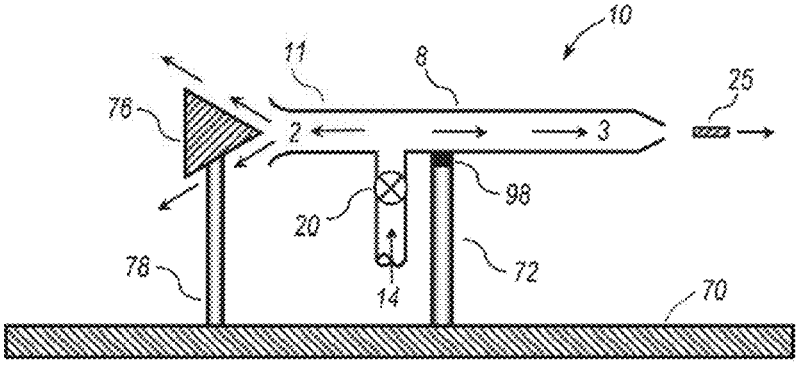
FIG. 9 is a schematic diagram of another embodiment of the invention.

FIG. 9 illustrates another embodiment of a gas powered fluid gun 10 with recoil mitigation device 74 and 77. Gun barrel 8 is mounted on support platform 70 with post 72. Gun barrel 8 can pivot or swivel around a vertical axis and/or a horizontal axis on post 72 in a direction pointing at a target. Recoil mitigation device 76 comprises a cone 76 mounted on post 78, which is also attached to platform 70, and an angled recoil plate 77 mounted to plate 74. Recoil cone 76 is located adjacent to, but not attached to, the rear end 11 of gun barrel 8. Rearward-flowing stream 2 impacts recoil cone 76, which redirects the fluid flow into a conical sheet.

Although not specifically illustrated, the conically-shaped recoil mitigation device 76 in FIG. 9 can be substituted with any of the other recoil mitigation device schemes previously described and illustrated in FIGS. 5, 6, 7, and 8. These substitute recoil mitigation devices can be mounted on post 78, which is attached to platform 70.

FIG. 10 illustrates another embodiment of a gas powered fluid gun 10 with recoil mitigation. Gun barrel 8 is mounted on support platform 70 with post 72. Gun barrel 8 can swivel on post 72 in a direction pointing at a target. In this example, the recoil mitigation device comprises a cone attached to the rear end 11 of gun barrel 8. Support post 72 is mounted to a flat bed 92 of a truck. Compressor 86, gas storage tank 84, fluid storage tank 82, first and second gas supply lines 90 and 88, pressurization valve 94, are all mounted on flat bed 92 (or mounted on a skid 102 lying on flat bed 92). Fluid supply line 80 (which can be a flexible hose, like a firefighter hose) supplies pressurized fluid 14 from fluid storage tank 82 to an opening 7 in the side of gun barrel 8 (e.g., via a T-junction). The flow of pressurized fluid 14 into gun barrel 8 is controlled by fluid discharge valve 20, which can be triggered by an operator or by a signal from a computer.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A fluid gun system for propelling a stream or slug of a fluid at a high velocity towards a target, the system comprising:

a gun barrel having a central bore, an open front end, an open rear end, a side, and an opening through the side for conveying fluid into the central bore;

a fluid storage tank for containing a pressurized fluid;

a fluid supply line for supplying pressurized fluid from the fluid storage tank to the opening in the side of the gun barrel;

a fluid ejection valve disposed in the fluid supply line, for controlling flow of the pressurized fluid from the fluid storage tank to the opening in the side of the gun barrel; and a device attached to the open rear end that changes the pressure of fluid exiting the open rear end;

wherein the device comprises a cavitating venturi nozzle for flash vaporizing the rearward-moving stream.

2. The system of claim 1, wherein the device reduces or eliminates backwash from the rearward-moving stream.

3. The system of claim 1, wherein the device reduces or eliminates recoil forces acting on the gun barrel generated by a forward-moving stream of the fluid exiting from the front end of the gun barrel.

4. The system of claim 1, wherein the venturi forms a mist or cloud of vapor from the rearward-moving stream.

5. The system of claim 1, wherein the opening in the side of the gun barrel is located midway between both ends of the gun barrel.

6. The system of claim 1, further comprising:

a gas storage tank;

a compressor fluidically connected via a first gas supply line to the gas storage tank for pressurizing the gas storage tank with a gas at a pressure greater than ambient pressure;

a second gas supply line connecting the gas storage tank with the fluid storage tank;

a pressurization valve disposed in the second gas supply line;

a first pressure regulator disposed in the first gas supply line between the compressor and the gas storage tank; and a second pressure regulator disposed in the second gas supply line between the pressurization valve and the fluid storage tank.

7. The system of claim 1, additionally comprising a pressurized gas disposed inside the fluid storage tank, the gas selected from the group consisting of air, nitrogen, helium, carbon dioxide, nitrous oxide, steam, and combinations thereof.

8. The system of claim 1, additionally comprising a pressurized fluid disposed inside the fluid storage tank, the fluid comprising one or more items selected from the group consisting of water, seawater, lubricants, foaming agents, thickening agents, gelling agents, tagants, chemical agents, carbon dioxide, nitrous oxide, malodorants, hydrocarbons, fire suppressing agents, and combinations thereof.

9. The system of claim 8, wherein the pressurized fluid additionally comprises one or more items selected from the group consisting of polysaccharides, glycols, carboxymethylcellulose, hydroxyethylcellulose, acrylates, acrylim ides, polyethylene oxide, colloidal silica, and combinations thereof.

10. The system of claim 1, further comprising an adjustable nozzle attached to the front end of the gun barrel.

11. The system of claim 1, wherein the central bore of the gun barrel has an inside diameter that is different at the barrel's front end than at the barrel's rear end.

12. The system of claim 1, wherein the fluid ejection valve comprises a rapidly acting valve selected from the group consisting of an in-line plug valve, an electromagneticaly-controlled valve, and a pneumatically operated valve.

13. The system of claim 1, wherein the gun barrel is attached to a swivably and pilotable mount on a post.

14. The system of claim 13, wherein the swivable and pivotable mount comprises a universal-joint (U-joint).

15. The system of claim 13, wherein the post is mounted to a truck; and further wherein the fluid storage tank, gas storage tank, compressor, and associated equipment are also mounted on the flat bed of the truck.

* * * * *